US007765997B2

(12) United States Patent
Klöckener et al.

(10) Patent No.: US 7,765,997 B2
(45) Date of Patent: Aug. 3, 2010

(54) MAGAZINE FOR A FIREARM

(75) Inventors: Jürgen Klöckener, Möhnesee-Deiringsen (DE); Birgit Teipel, Sundern (DE); Franz Wonisch, Arnsberg (DE); Wulf-Heinz Pflaumer, Arnsberg (DE)

(73) Assignee: UMAREX Sportwaffen GmbH & Co. KG, Arnsberg (DE)

( * ) Notice: Subject to any disclaimer, the term of this patent is extended or adjusted under 35 U.S.C. 154(b) by 776 days.

(21) Appl. No.: 11/643,157

(22) Filed: Dec. 21, 2006

(65) Prior Publication Data

US 2010/0154765 A1 Jun. 24, 2010

(30) Foreign Application Priority Data

Dec. 8, 2006 (DE) ..... 20 2006 018 601 U

(51) Int. Cl.
*F41A 9/76* (2006.01)

(52) U.S. Cl. ..... 124/48; 42/50

(58) Field of Classification Search ..... 124/48; 42/50; 89/33.14–33.25
See application file for complete search history.

(56) References Cited

U.S. PATENT DOCUMENTS

| | | | | | |
|---|---|---|---|---|---|
| 1,314,013 | A | * | 8/1919 | Mulvey | 42/19 |
| 1,436,232 | A | * | 11/1922 | Bohnak | 89/33.16 |
| 3,060,809 | A | * | 10/1962 | Tschumi | 89/33.16 |
| 4,026,212 | A | * | 5/1977 | Dardick | 102/531 |
| 4,037,344 | A | * | 7/1977 | Reed | 42/16 |
| 4,123,963 | A | * | 11/1978 | Junker | 89/152 |
| 4,468,875 | A | * | 9/1984 | Harrison et al. | 42/50 |
| 4,819,609 | A | | 4/1989 | Tippmann | |
| 4,993,400 | A | * | 2/1991 | Fitzwater | 124/48 |
| 5,186,156 | A | * | 2/1993 | Clayton | 124/59 |
| 5,295,320 | A | * | 3/1994 | Svensson | 42/49.01 |
| 5,522,374 | A | * | 6/1996 | Clayton | 124/59 |
| 5,660,159 | A | * | 8/1997 | Clayton | 124/66 |
| 5,906,191 | A | | 5/1999 | Wonisch et al. | |
| 6,666,203 | B2 | * | 12/2003 | Maeda et al. | 124/48 |
| 6,736,125 | B2 | | 5/2004 | Petrosyan et al. | |
| 7,146,898 | B2 | | 12/2006 | O'Dwyer | |
| 2004/0040551 | A1 | * | 3/2004 | Menow et al. | 124/71 |

FOREIGN PATENT DOCUMENTS

| | | |
|---|---|---|
| CA | 1 264 128 | 1/1990 |
| DE | 195 42 332 C1 | 5/1997 |
| DE | 196 35 657 A1 | 3/1998 |
| EP | 1 265 049 A2 | 12/2002 |
| GB | 425755 | 3/1935 |

* cited by examiner

*Primary Examiner*—Troy Chambers
(74) *Attorney, Agent, or Firm*—Laurence A. Greenberg; Werner H. Stemer; Ralph E. Locher

(57) ABSTRACT

Magazine (1) for a firearm, in particular for a semiautomatic CO2 or compressed-air firearm, comprising a basic magazine body, a number of projectile supports (2) for the reception of projectiles (3) as well as a transport means for the projectile supports, whereas the transport means is designed for receiving the projectile supports (2) movably with respect to the basic magazine body, whereas the transport means is designed for moving the projectile supports (2) in a circuit, whereas the transport means has at least one endless transport belt (4), whereas the projectile supports (2) are connected to the transport belt (4).

22 Claims, 4 Drawing Sheets

MAGAZINE FOR A FIREARM

BACKGROUND OF THE INVENTION

Field of the Invention

The present invention relates to a magazine for a compressed-air or CO2 firearm having a basic magazine body, a number of projectile supports for the reception of projectiles, and transport device for the projectile supports. The transport device are configured to receive the projectile supports movably with respect to the basic magazine body, and the transport device are configured to move the projectile supports in a circuit.

A compressed-air or CO2 firearm functions with a gas portion as propellant. For the sake of simplicity, only a CO2 firearm will be referred to below, but firearms are meant which are designed to shoot a projectile by means of a gas portion.

By the trigger being actuated, the projectile is accelerated by means of the gas pressure and emerges from the barrel. In case a semiautomatic CO2 firearm is concerned, it is necessary to ensure that, before the next shot is fired, a projectile is fed automatically to a projectile transfer region, that is to say to an interface between the firearm and magazine.

The projectiles for a CO2 firearm are distinguished, in particular, in that they do not have a specific propellant charge. To shoot the projectiles, therefore, it is necessary to ensure that the projectile is fed to a region between the CO2 source and the barrel. It is clear that, because of this, the magazine for a firearm of this type has to fulfill particular requirements.

A magazine for a compressed-air or CO2 firearm became known from EP 1 265 049 A2. Here, a magazine for projectile-shooting air pressure weapons with a housing is proposed. Inside the housing is located a closed duct which is equipped with projectile-receiving projectile supports (called containers here). Above the duct, there is a window for loading the projectile support with the projectiles. The magazine possesses, in the wall of the housing, a projectile port through which the projectile, when fired under the action of a gas portion, passes out of the projectile support into the projectile duct of the firearm barrel. The port lies coaxially with the projectile duct over the firearm barrel and with the continuous bore of the projectile support which takes such a position before each shot. A window for an outer lever of the trigger device is provided in the wall of the housing, above the closed duct and above the continuous bores of the projectile supports, under the action of which outer lever the projectile supports are moved through the closed duct in a successive arrangement of each projectile support on the trajectory. The sidewall of the housing has formed on it a longitudinal port for displacing the projectile supports under the action of a finger of the marksman when these are being loaded with the projectiles.

However, the abovementioned magazine has some disadvantages. In particular, the loose reception of the projectile supports within the magazine entails an appreciable risk of tilting. Also, the individual tolerances of the projectile supports add up, so that, in production terms, the tolerance-true manufacture of the projectile supports has to satisfy considerable requirements. Furthermore, the transport of the projectile supports is relatively complex to carry out, and, in particular, separate longitudinal ports, into which corresponding weapon-side driving means can engage, have to be formed in the housing of the magazine. This results in a further disadvantage, in that said transport device engages directly into the projectile support, that is to say into the projectile support provided within the projectile support. It can easily be seen that this is accompanied by a wear of the actual projectile support, this ultimately leading to the magazine becoming unusable.

SUMMARY OF THE INVENTION

This is where the present invention comes in, its object being to provide a magazine according to the preamble of claim 1, which makes it possible for projectiles to be fed reliably to the firearm. Also, the proposed magazine is basically to be designed to ensure a transport of the projectile supports, without transport being accompanied by a wear of the projectile support.

According to the invention, this object is achieved by means of a magazine having the defining features of claim 1. Since the transport means has at least one endless transport belt, the projectile support has been connected to the transport belt, the projectile supports can be moved, without being received in a duct. The projectile supports also correspondingly cannot tilt. Furthermore, the measure proposed according to the invention affords numerous possibilities of implementing the drive for moving the projectile supports. To be precise, by the projectile supports being connected by means of the transport belt, no duct for guiding the projectile supports is required, so that not only can the projectile supports be driven via the inner projectile support, that is to say be moved in a transport direction, but the outer surface of the projectile support is also basically available for the engagement of a transport device.

In a preferred embodiment of the present invention, there may be provision for the projectile supports to be connected to the transport belt via webs. The projectile supports may correspondingly be spaced apart from the transport belt in a desired way. Apart from the fact that this can afford an advantageous possibility for the adaption of a corresponding firearm, an advantageous spacing of the projectile supports apart from one another is obtained, in case the transport belt is deflected through, for example, 180° degrees on a roller. For example, a transport device of a firearm can suitably engage on the surface of the projectile supports in an advantageous way.

For production reasons, there may advantageously be provision for the projectile supports and the transport belt to be formed in one piece. Such an arrangement of the projectile supports and transport belt can be produced very simply, for example, in a plastic injection molding method. The transport belt may advantageously be distinguished by elastic properties. Correspondingly, for example, the transport belt can advantageously be deflected on a roller arrangement.

To stabilize the projectile supports in a transport direction, there may advantageously be provision for the transport belt to be a flat belt of rectangular cross section. This correspondingly affords high stability in the direction of the belt plane.

There may preferably be provision for the projectile support to be a hollow cylinder. Such a form is advantageously suitable as a projectile support, since a projectile, on the one hand, can be received within the projectile support and, furthermore, can even be "shot" out of the projectile support into a barrel, for example in case a gas portion is introduced directly into the projectile support.

A simple, stable and lightweight construction of a magazine according to the invention is obtained in that the basic magazine body has a magazine shoe and a frame oriented perpendicularly or essentially perpendicularly to the magazine shoe.

To receive rollers which may be considered, for example, for receiving the transport belt, there may advantageously be provision for the frame to have at least one first column and preferably one second column. Such a design is light and stable and basically affords the possibility, between the columns, of receiving suitable rollers for the reception of the transport belt.

In an advantageous embodiment of the present invention, there may be provision for the transport means to have at least one first roller and one second roller, the rollers being connected rotatably to the frame, the rollers being spaced apart from one another, and the endless transport belt being laid around the rollers and being tensioned between the rollers. A transport means configured in this way affords numerous advantages, as compared with the prior art. On the one hand, the projectile supports cannot tilt, as may be the case, however, with projectile supports guided within a duct. Furthermore, highly frictionless transport can be ensured by means of the rollers. Manufacturing tolerances have to be borne in mind to a relatively slight extent, since, for example, deviations of the transport belt can be compensated relatively simply by the rollers, for example by the roller spacing being adapted, particularly for the purpose of an exact positioning of the projectile support in front of a barrel of a firearm.

In an advantageous embodiment of the present invention, it is appropriate for the rollers to be received between the columns. This accordingly affords the possibility of receiving the rollers on both sides, thus resulting in a high load bearing capacity of the rollers.

Correspondingly, the transport belt can be tensioned and offers only slight spring deflection in the regions between the rollers.

In a further advantageous embodiment of the proposed magazine, there may be provision for at least one column to have a greater width than at least one roller, so that the transport belt or else the projectile supports can be guided at least partially by the wider column. This results correspondingly in a gain in stability.

In a further advantageous embodiment of the present invention, there may be provision for the roller to be received on hollow-cylindrical protuberances of the columns, whereas a screw is extended into the hollow-cylindrical protuberances in order to connect the columns. Accordingly, the rollers can be exchanged or removed for maintenance purposes.

For the reception of a multiplicity of projectiles, there may advantageously be provision for a number of projectile supports to be arranged on the transport belt, whereas the projectile supports have a longitudinal axis, and whereas the longitudinal axes are oriented parallel to one another and to the axis of rotation of the at least one roller. According to the orientation of the projectile supports, a "chain magazine" is obtained, which can be loaded in a simple way.

There may be provision for the projectile support to be suitable at least for receiving a projectile, in particular a diabolo, a steel ball, a BB bullet, a paintball or a comparable projectile without a specific propellant charge. This correspondingly affords a broad range of use of the magazine for different firearms which are based on the principle of the delivery of a gas portion.

Accordingly, there may advantageously be provision for the projectile support to be designed at least such that the projectile can be transported out of the projectile support by means of the introduction of a gas portion into the projectile support. Such a transport possibility is appropriate for the magazine according to the invention, proposed here, in particular since an open type of construction of the magazine is obtained due to the reception of the projectile supports on the transport belt.

As an interface with a firearm into which the magazine can be inserted, there may advantageously be provision for the magazine to form a projectile transfer region which is designed to transfer a projectile received in a projectile support to the firearm.

In this respect, there may advantageously be provision for the projectile transfer region to be formed from the projectile support projecting in each case on the head side of the frame. Contrary to other magazines, the projectile transfer region is not formed, for example, by a bore within a magazine housing, but, instead, by the projectile support as such. The head region of the magazine proposed here is therefore appropriate, since the projectile supports are further apart from one another due to the deflection of the roller than is the case along the columns. Accordingly, a projectile support which is located in the head region offers a relatively large amount of free space, so that, for example, a suitable chain slide for driving the magazine, in particular for moving the transport belt, can engage on the projectile support located in the head region of the magazine. Furthermore, a projectile support located in the head region offers a correspondingly accessible bearing surface, so that, for example, a correspondingly configured projection of a chain slide can come to bear in order to stabilize the projectile support while the shot is being fired.

In particular, the transport means is distinguished in that the transport means is designed to remove a projectile support from the projectile transfer region and to transport a following projectile support into the projectile transfer region.

BRIEF DESCRIPTION OF THE DRAWINGS

Further features and advantages of the present invention become clear from the following description of preferred exemplary embodiments, with reference to the accompanying figures in which.

DESCRIPTION OF THE PREFERRED EMBODIMENTS

Figure 1:
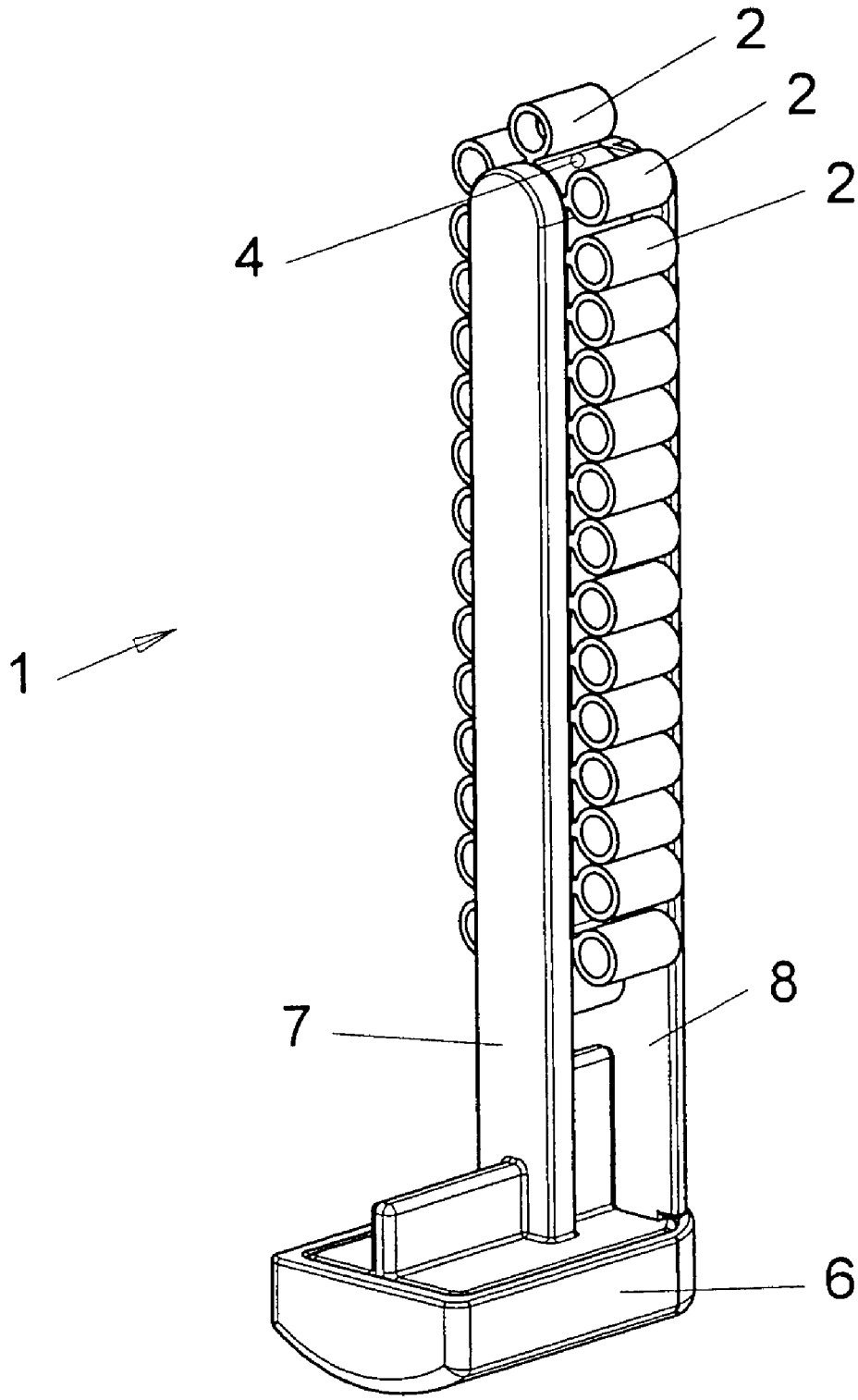
FIG. 1 shows a perspective view of a magazine according to the invention.
Figure 2:
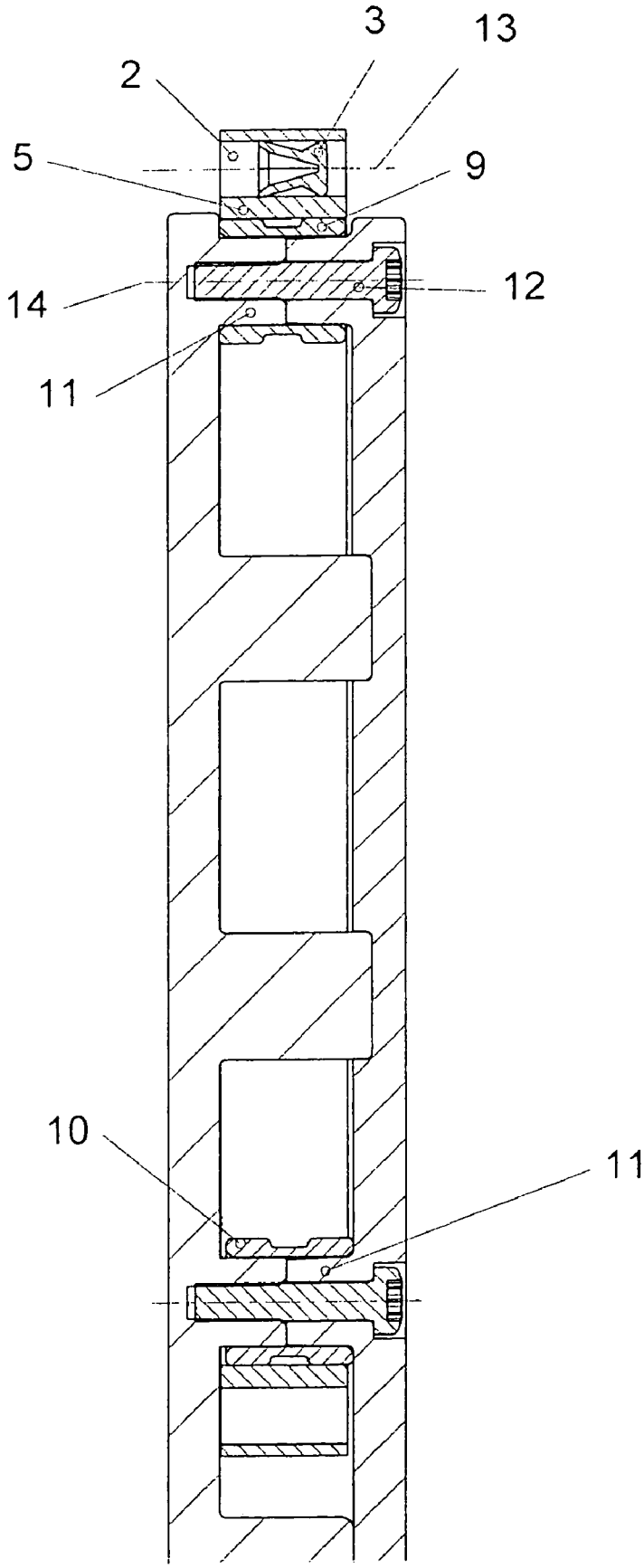
FIG. 2 shows a lateral sectional illustration of a magazine according to the invention.
Figure 3:
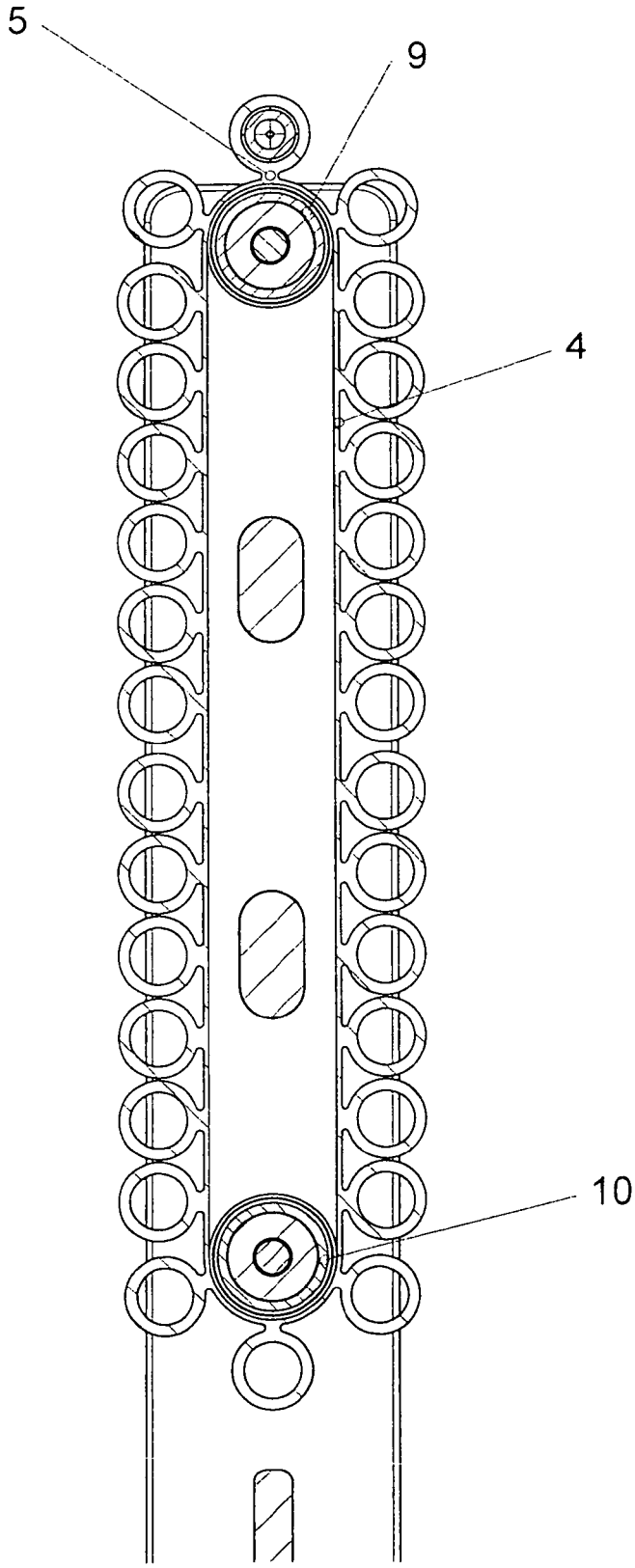
FIG. 3 shows a frontal sectional illustration of a magazine according to the invention.
Figure 4:
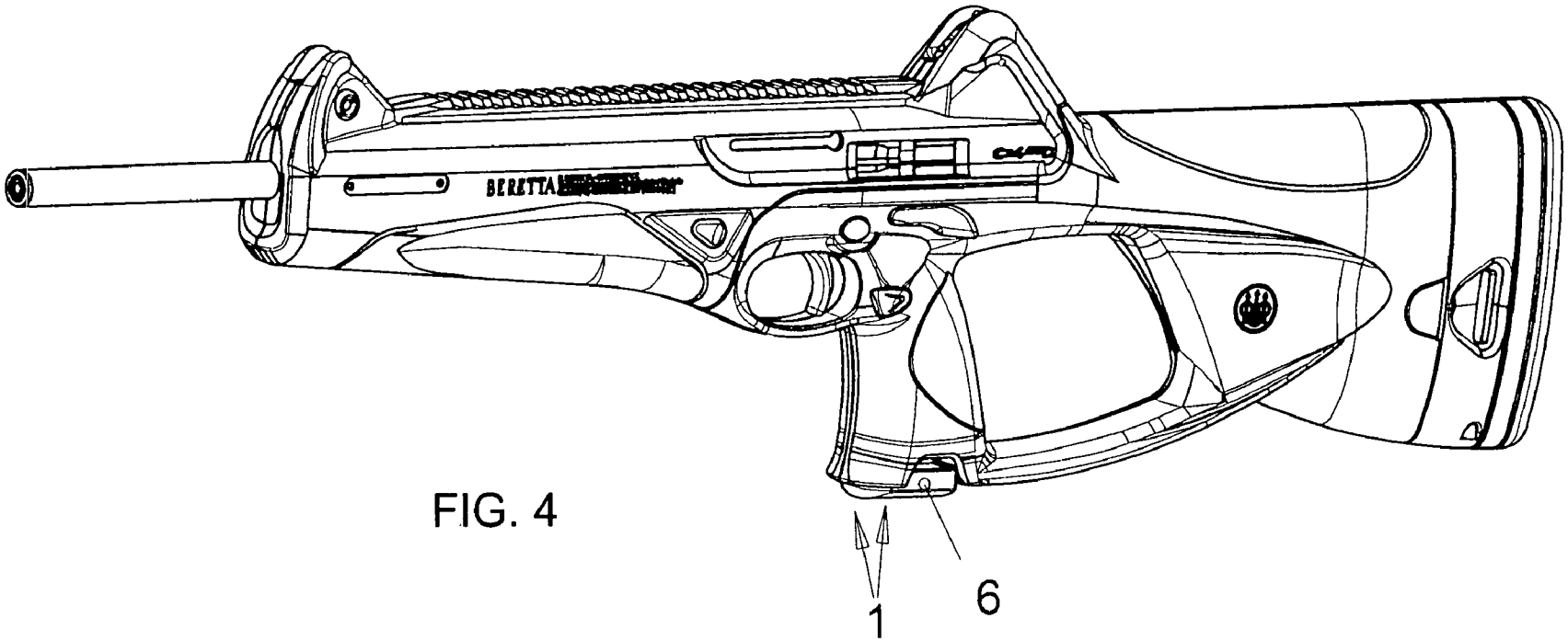
FIG. 4 shows a firearm with a magazine according to the invention.

A magazine 1 according to the invention comprises essentially a basic magazine body, a number of projectile supports 2 for the reception of projectiles 3, and a transport means which is designed both to receive the projectile supports 2 movably with respect to the basic magazine body and to move the projectile supports 2 in a circuit, that is to say in a continuous loop.

The basic magazine body comprises a magazine shoe 6 and a frame. The frame extends approximately perpendicularly from the magazine shoe 6 and comprises a first column 7 and a parallel second column 8. The magazine 1 is basically designed to be inserted into a magazine receptacle of a corresponding firearm.

The transport means for the projectile supports 2 may be configured as follows in a preferred embodiment.

Between the columns 7, 8 are mounted a first rotatable roller 9 and a second rotatable roller 10. The first roller 9 is provided on the head side of the frame, while the second roller 10 is arranged above the magazine shoe 6. The rollers 9, 10 are mounted rotatably on axes of rotation, the axes of rotation consisting of hollow-cylindrical protuberances 11 of the columns 7, 8, whereas a screw 12 is extended through the hollow-cylindrical protuberances 11 in order to connect the columns 7, 8. The rollers 9, 10 may be removed, for example for maintenance purposes. The rollers 9, 10 are oriented parallel to one another, are spaced apart from one another and form a receptacle for a transport belt 4.

The transport belt 4 is a flat, reasonably elastic and endless belt which is laid around the rollers 9, 10 and is tensioned correspondingly between the rollers 9, 10. The transport belt 4 may correspondingly revolve endlessly between the rollers. The projectile supports 2 are connected to the transport belt 4, in particular the projectile supports 2 are arranged in each case on the transport belt 4 via a web 5.

There may advantageously be provision for at least one of the columns 7, 8 to be wider than at least one of the rollers 9, 10, so that the transport belt 4 or else the projectile supports 2 can be guided at least partially by the wider column.

As already mentioned above, the magazine 1 according to the invention is equipped with a number of projectile supports 2, whereas each projectile support 2 is suitable for receiving a projectile 3 in each case. A projectile support 2 has an essentially hollow-cylindrical configuration, whereas a cross section of the inner space is matching at least partially the cross section of the projectile 3 to be received. A slight undersize of the projectile support 2 is advantageous for holding the projectile 3. Alternative methods for holding the projectile 3, such as, for example, suitable profilings, may, of course, also be envisaged. The inner space of the projectile support 2 is likewise designed such that the projectile 3 received can be expelled from the projectile support 2 by means of a gas portion. This may advantageously take place by the introduction of a gas portion on one side of the projectile support 2, whereas the projectile 3 is expelled on the other side of the projectile support 2 by the pressure of the gas, for example into a barrel. Mechanical solutions, for example in the form of a rod which is designed to push the projectile 3 out of the projectile support 2 into a barrel or valve chamber, may, of course, also be envisaged.

Furthermore, the projectile supports 2 are arranged in a row along the transport belt 4. In case a geometric longitudinal axis 13 of the projectile support 2 is assumed, the longitudinal axes 13 of the projectile supports 2 are oriented preferably parallel to one another and parallel to the axes of rotation 14 of the rollers 9, 10. The arrangement of the projectile supports 2 and transport belt 4 recalls a chain in which the projectile supports 2 are lined up one behind the other in the same way as chain links. Accordingly, the proposed magazine 1 according to the invention could also be referred to as a "chain magazine".

The magazine 1 forms a projectile transfer region. The projectile transfer region is distinguished in functional terms in that it is an interface between the magazine 1 and firearm, such that a projectile 3 received in the projectile support 2 can be transferred to the firearm, preferably to the barrel. In the magazine 1 proposed here, the projectile transfer region is formed by the projectile support located in each case on the head side of the frame and above the roller 9, in particular since both sides of the projectile support 2 are accessible, so that the projectile support 2 can basically be acted upon with a gas portion from one side and the projectile 3 can emerge on the other side. Other positions may, of course, also be envisaged.

In conjunction with the transport means, the projectile supports 2 can basically pass across the projectile transfer region infinitely often. However, in case a loaded magazine 1 is taken, that is to say all the projectile supports 2 are equipped with a projectile 3, there is preferably provision in each case for an empty projectile support 2 to be moved out of the projectile transfer region while the next projectile support 2 having a projectile 3 is moved into the projectile transfer region. This operation may be repeated correspondingly, preferably until the magazine 1 is "shot empty", that is to say projectiles are no longer located in the projectile supports.

The magazine 1 proposed according to the invention affords advantageous drive possibilities for the magazine 1 due to the transport belt 4 and to the arrangement of the projectile supports 2 on the transport belt 4. For example, there is the possibility of bringing a transport device located on the firearm side into engagement with the surface of a projectile support 2. In case an individual projectile support 2 is moved in a transport direction, all further projectile supports 2 connected to the transport belt 4 are likewise moved in the transport direction. Accordingly, the transport device can basically engage on any desired projectile support 2 in order to move the projectile support 2 located in the projectile transfer region out of the projectile transfer region or in order to move a following projectile support 2 into the projectile transfer region. Advantageously, however, an engagement of a transport device may take place directly in the projectile transfer region, since, due to the deflection of the roller 9, the projectile supports 2 are furthest away from one another in this region and can therefore be grasped advantageously. In contrast to the prior art in which the projectile supports 2 are not guided on a transport belt 4, but, for example, in a closed duct, the configuration, proposed here, of the transport means of the magazine affords advantageous drive possibilities. There does not necessarily need to be an engagement of the transport device of the firearm in the inner space, provided for receiving the projectiles, of the projectile support 2, and therefore the inner space, intended for the projectiles, of the projectile support 2 does not have to undergo wear.

A further advantage which arises particularly by virtue of the transport belt 4 of the magazine 1 proposed according to the invention is that the projectile supports 2 can be transported within the magazine 1 or the basic magazine body, without this entailing the risk of tilting. This advantage arises particularly from the fact that the projectile supports 2 are guided by the transport belt 4 and are not received in a duct. Correspondingly, a force in the transport direction, which acts, for example, on a single projectile support 2, is transmitted to the entire transport belt 4, with the result that all the projectile supports 2 are moved in a similar way to a caterpillar drive. However, the force cannot lead to a situation where, for example, the projectile supports 2 are pressed against a duct wall, are set transversely and are subsequently tilted.

A drive of the roller 9 and/or of the roller 10 may, of course, also be envisaged. Such a drive possibility is not possible with a magazine 1 which implements a guidance of the projectile supports 2 by means of a duct.

We claim:

1. A magazine for a firearm, the magazine comprising:

a basic magazine body removably mountable to the firearm;

a plurality of individual hollow-cylindrical projectile supports open at both ends for receiving projectiles;

a transport device configured to receive said projectile supports movably with respect to said basic magazine body, said transport device including at least one endless transport belt movably disposed relative to said basic magazine body and having said projectile supports connected thereto, and said transport device being configured to move said projectile supports in a circuit.

2. The magazine according to claim 1, wherein the magazine is configured for a semiautomatic CO2 or compressed-air firearm.

3. The magazine according to claim 1, which comprises a web connecting said projectile support to said transport belt.

4. The magazine according to claim 1, wherein said projectile supports and said transport belt are formed in one piece.

5. The magazine according to claim 1, wherein said transport belt is an elastic belt with elastic properties.

6. The magazine according to claim 1, wherein said transport belt is a flat belt of substantially rectangular cross section.

7. The magazine according to claim 1, wherein said basic magazine body has a magazine shoe and a frame oriented substantially perpendicularly to said magazine shoe.

8. The magazine according to claim 7, wherein said frame has at least one column.

9. The magazine according to claim 7, wherein said frame has at least a first column and a second column.

10. The magazine according to claim 1, wherein said transport device includes a first roller rotatably mounted to said frame and at least one second roller rotatably mounted to said frame at a spaced distance from said first roller, and wherein said endless transport belt is laid around and is tensioned between said first and second rollers.

11. The magazine according to claim 9, wherein said transport device includes a first roller rotatably mounted rotatably mounted between said first and second columns and at least one second roller rotatably mounted between said first and second columns at a spaced distance from said first roller, and wherein said endless transport belt is laid around and is tensioned between said first and second rollers disposed between said first and second columns.

12. The magazine according to claim 11, wherein at least one of said first and second column has a greater width than a diameter of at least one of said rollers.

13. The magazine according to claim 9, wherein said columns are formed with hollow-cylindrical protuberances, said rollers are received on said protuberances, and a screw is extended in said protuberances in order to connect said columns.

14. The magazine according to claim 1, wherein said transport belt carries a plurality of said projectile supports each oriented parallel to a longitudinal axis, parallel to one another, and parallel to an axis of rotation of at least one roller supporting said transport belt.

15. The magazine according to claim 1, wherein each said projectile support is configured for receiving a projectile formed without a specific propellant charge.

16. The magazine according to claim 1, wherein said projectile supports are configured to receive projectiles selected from the group consisting of diabolos, steel balls, BB bullets, or paintball projectiles.

17. The magazine according to claim 1, wherein said projectile supports are configured to enable a respective projectile to be transported out of a respective said projectile support by introduction of a gas charge into said projectile support.

18. The magazine according to claim 1, wherein said magazine is formed with a projectile transfer region configured to transfer a projectile from a respective projectile support to the firearm.

19. The magazine according to claim 18, wherein said transport device is configured to remove a projectile support from said projectile transfer region and to transport a following projectile support into said projectile transfer region.

20. The magazine according to claim 18, wherein said projectile transfer region is defined by a respective projectile support projecting from an upper side of said frame.

21. A magazine for a firearm, the magazine comprising:

a basic magazine body removably mountable to the firearm;

a plurality of projectile supports for receiving projectiles, said projectile supports being configured to enable a respective projectile to be transported out of a respective said projectile support by introduction of a gas charge into said projectile support;

a transport device configured to receive said projectile supports movably with respect to said basic magazine body, said transport device including at least one endless transport belt having said projectile supports connected thereto, and said transport device being configured to move said projectile supports in a circuit relative to said basic magazine body.

22. The magazine according to claim 21, wherein said projectile supports are individual hollow cylinders.

* * * * *